US011591827B2

(12) United States Patent
Amato

(10) Patent No.: US 11,591,827 B2
(45) Date of Patent: Feb. 28, 2023

(54) LOCK

(71) Applicant: FEMTO ENGINEERING S.R.L., San Casciano in Val di Pesa (IT)

(72) Inventor: Giuseppe Amato, Siena (IT)

(73) Assignee: LCI ITALY S.R.L., San Casciano In (IT)

( * ) Notice: Subject to any disclaimer, the term of this patent is extended or adjusted under 35 U.S.C. 154(b) by 202 days.

(21) Appl. No.: 16/943,136

(22) Filed: Jul. 30, 2020

(65) Prior Publication Data

US 2021/0032909 A1 Feb. 4, 2021

(30) Foreign Application Priority Data

Aug. 2, 2019 (IT) ..... 102019000013797

(51) Int. Cl.

| | |
|---|---|
| ***E05B 79/04*** | (2014.01) |
| ***E05B 79/06*** | (2014.01) |
| ***E05B 79/20*** | (2014.01) |
| ***E05B 83/44*** | (2014.01) |

(52) U.S. Cl.

CPC ..... *E05B 79/04* (2013.01); *E05B 79/06* (2013.01); *E05B 79/20* (2013.01); *E05B 83/44* (2013.01)

(58) Field of Classification Search

CPC ..... E05B 79/04; E05B 79/06; E05B 79/20; E05B 83/44; E05B 81/16; E05B 83/36; E05B 85/00; E05B 81/32; B60P 3/32; B60P 3/36

See application file for complete search history.

(56) References Cited

U.S. PATENT DOCUMENTS

| | | | | |
|---|---|---|---|---|
| 9,085,921 | B2 * | 7/2015 | Pellegrini | E05B 81/14 |
| 11,180,935 | B2 * | 11/2021 | Takagi | E05B 81/06 |
| 11,352,819 | B2 * | 6/2022 | Yokota | E05B 81/34 |

FOREIGN PATENT DOCUMENTS

| | | | |
|---|---|---|---|
| DE | 19758078 | A1 | 7/1999 |
| DE | 202011101607 | U1 | 9/2012 |
| DE | 102016010672 | A1 | 3/2018 |
| DE | 102018100301 | A1 | 7/2019 |

OTHER PUBLICATIONS

Italian Search Report dated Apr. 20, 2020 from counterpart Italian App No. 201900013797.

* cited by examiner

*Primary Examiner* — Kristina R Fulton
*Assistant Examiner* — Thomas L Neubauer
(74) *Attorney, Agent, or Firm* — Shuttleworth & Ingersoll, PLC; Timothy J. Klima

(57) ABSTRACT

A lock includes a base and movable element connected to a handle operable by a user and movable between a first position corresponding to an open condition of the handle and a second position corresponding to a closed condition. An operating element is rotatably mounted on the base and connected to a device for releasing a closing panel, and is rotatable between a first position corresponding to an open condition of the panel and a second position corresponding to a closed condition. A transmission acts between the movable an operating elements and kinematically connects the movable and operating elements such that movement of the movable element causes rotation of the operating element. An uncoupling device acts on the transmission for disengaging kinematically, and in a controlled way, the movable element from the operating element to disable actuation of the operating element by the movable element.

13 Claims, 7 Drawing Sheets

LOCK

This application claims priority to Italian Patent Application 102019000013797 filed Aug. 2, 2019, the entirety of which is incorporated by reference herein.

This invention relates to a lock.

More specifically, this invention is widely used in the technical field of locks for caravans and campervans.

In accordance with the prior art, a plurality of different types of locks are available on the market, specially developed to allow the closing of the doors of caravans and campervans.

Disadvantageously, these locks comprise a large number of components the motion of which must be meticulously calibrated so as to guarantee a correct closing or opening of the door.

Moreover, these components are commonly made of different types of material which, having different thermal expansion coefficients, modify the relative dimensions, changing the relative clearances and, with them, the kinematic chain of the entire lock.

More specifically, the dimensional variations induced by the thermal excursions cause the onset of forces on the lock which can determine the failure.

Although these variations can be partly overcome by recurrent adjustment of the clearances of the lock in order to protect the essential functions of the lock, these adjustments are often not very effective and tend to reduce the functionality of the lock.

Disadvantageously, moreover, the vibrational stresses induced by the movement through the locking elements, for example the latches, on the lock blocking mechanism determines a reduction in the operating life.

The technical purpose of the invention is therefore to provide a lock which is able to overcome the drawbacks of the prior art.

The aim of the invention is therefore to provide a lock which is particularly efficient and which has an increased duration of the operating life compared with the prior art devices.

The technical purpose indicated and the aim specified are substantially achieved by a lock with the technical features described in one or more of the appended claims.

Further features and advantages of this invention are more apparent in the non-limiting description below, with reference to a preferred, non-limiting, embodiment of a lock as illustrated in the accompanying drawings, in which.

Figure 1:
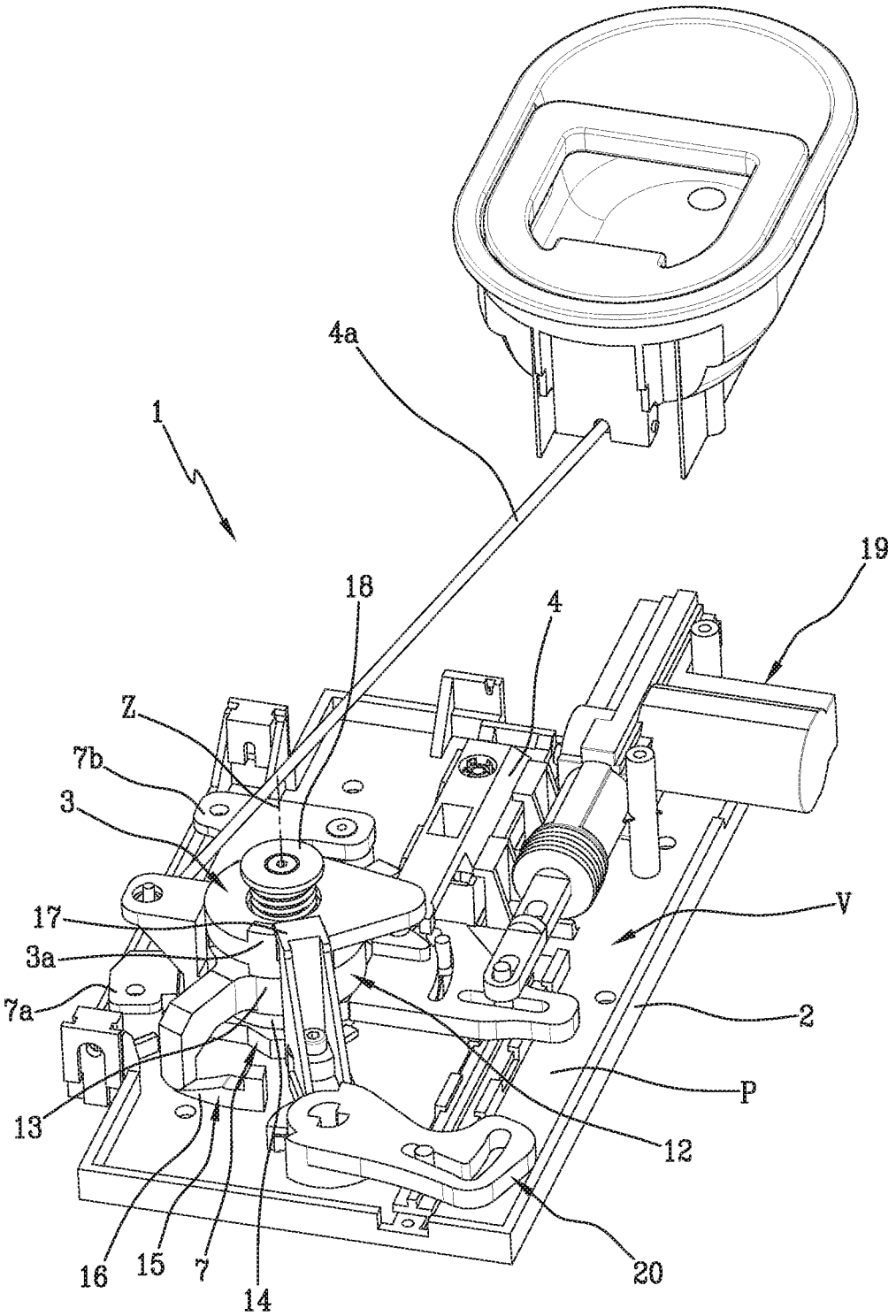
FIG. 1 is a perspective view of a lock according to the invention.
Figure 2:
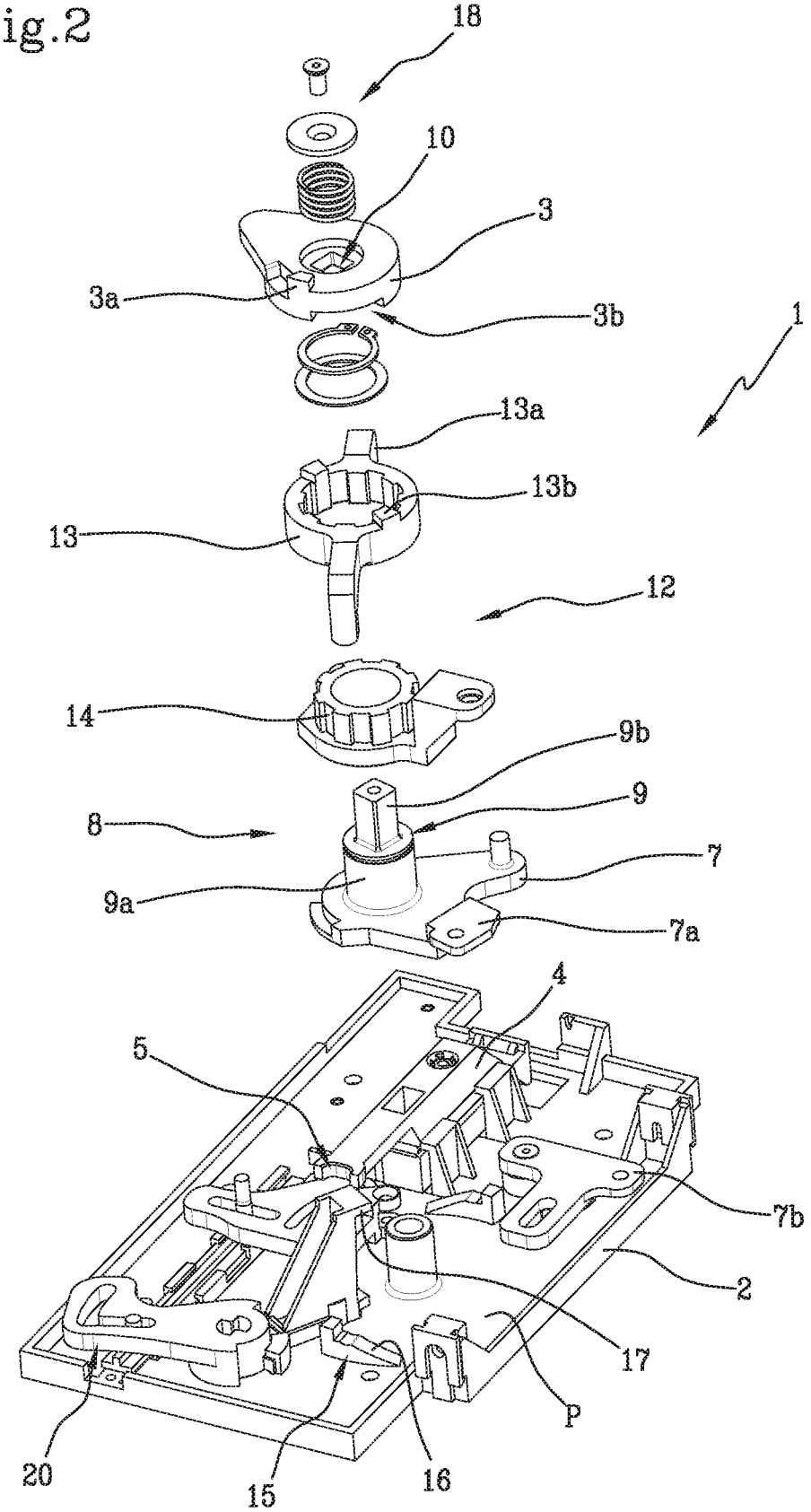
FIG. 2 is an exploded view of a lock according to a possible embodiment of the invention.
Figure 3:
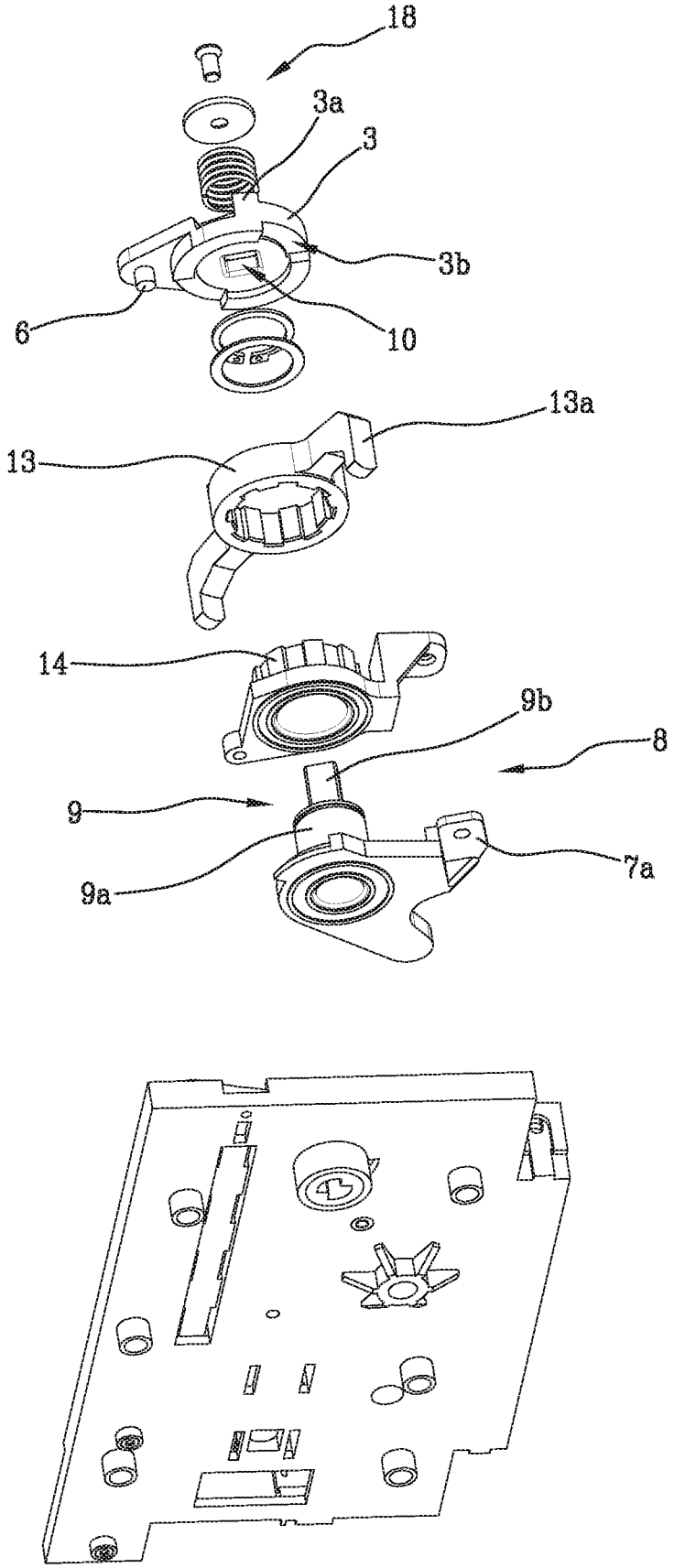
FIG. 3 is a further exploded view of the lock according to a possible embodiment of the invention.
Figure 4:
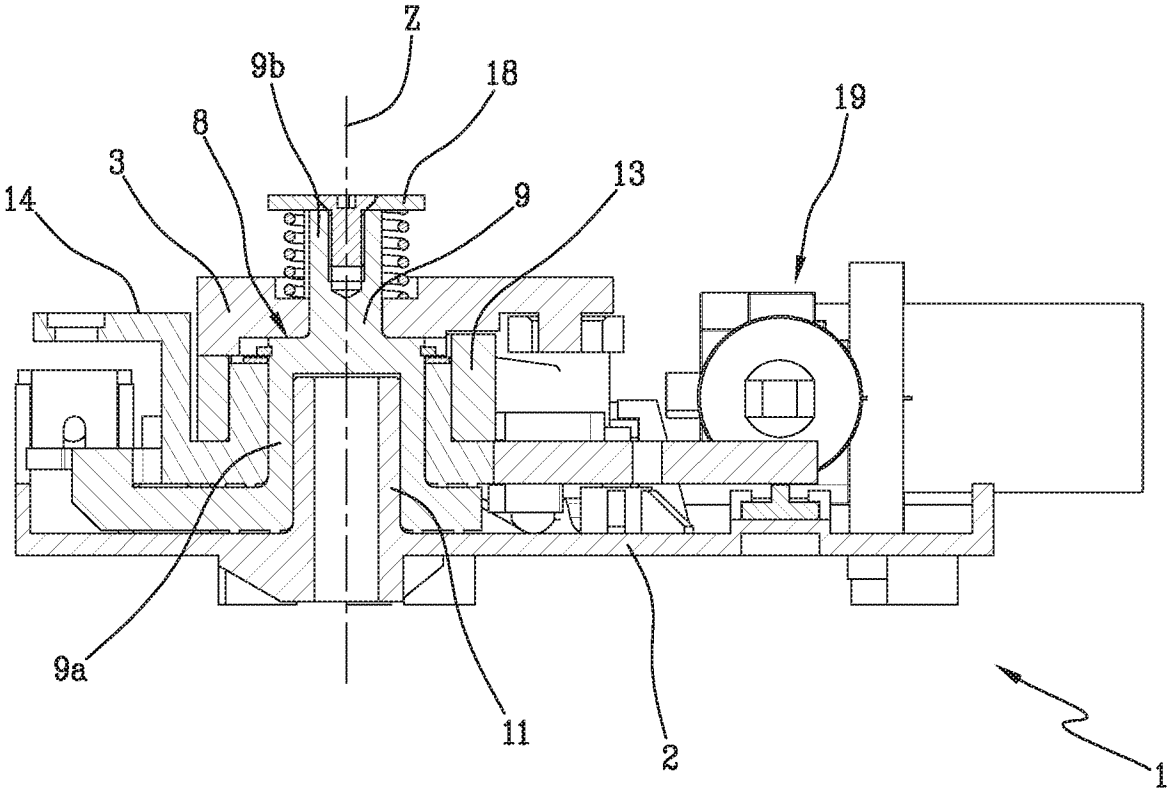
FIG. 4 is a cross section view of the lock according to the invention according to a possible operating condition.

With reference to the accompanying drawings, the numeral 1 denotes in its entirety a lock.

Advantageously, the lock 1 is connectable to a closing panel, for example a sash, a window or a door, in such a way as to allow a reversible passage between an open condition and a closed condition and vice versa.

More specifically, the lock 1 may find large possibilities of application in the technical field of caravans and/or campervans.

The lock 1 comprises a supporting base 2 defining a main lying plane "P".

Advantageously, the supporting base 2 may be coupled to a cover in such a way as to define a containment space "V" for the components of the lock which will be subsequently specified.

Preferably, the supporting base 2 and/or the above-mentioned cover may be made of plastic material.

The lock may also comprise a control element 3 configured to allow a reversible passage of the panel from an open condition to a closed condition and vice versa.

More specifically, the term "closed condition" of the panel means a condition wherein the panel is coupled to a respective frame and prevents the passage of a user.

Vice versa, the term "open condition" means a condition wherein the panel is uncoupled from the frame allowing the passage of a user.

The control element 3 is connected to the supporting base 2 and is rotatable relative to it about an axis of rotation "Z".

The axis of rotation "Z" is transversal, preferably perpendicular, to the plane "P".

Moreover, the control element 3 is connected or connectable to a control handle which can be operated by a user.

The expression "connected or connectable" means that the control element 3 is designed to be connected to a control handle which can be operated by a user.

More specifically, the control element 3 is rotatable between a first position corresponding to an open condition of the panel and a second position corresponding to a closed condition of the panel.

Advantageously, the lock 1 comprises a movable element 4 designed to connect the control handle to the control element 3.

In this way, the movable element 4 makes it possible to transmit to the control element 3 the actuation imparted by the user to the handle.

Preferably, the movable element 4 is movable in a sliding or translation fashion between a first position corresponding to an open condition of the handle and a second position corresponding to a closed condition of the handle.

Advantageously, the movable element 4 may be coupled to the control element in such a way that a movement of the movable element 4 causes a rotation of the control element 3 about the axis of rotation "Z".

Preferably, the movable element 4 and the control element 3 have, respectively, a fork-shaped portion 5 and a coupling pin 6 defining a kinematic coupling.

In accordance with a possible embodiment of the invention, the movable element 4 is defined by a rod or slider equipped with translational movement and coupled to the control element 3 in an eccentric portion relative to the axis Z by means of the coupling pin 6 positioned inside the respective fork-shaped portion 5.

In other words, the movable element 4 is configured for making contact on the coupling pin 6 by means of the fork-shaped portion 5 for imparting a rotation to the control element 3.

In the closed condition of the panel, the actuation of the handle causes the movement of the movable element 4 from the second position towards the first position which causes the fork-shaped portion 5 to push the coupling pin 6 promoting the passage of the panel to an open condition.

After the movement of the coupling pin 6, the movable element 4 translates until reaching the second position by disengaging the kinematic coupling between the coupling pin 6 and the movable element 4.

Preferably, there are elastic return means acting on the movable element 4 which determine a return from the first position to the second position.

The movement of the panel from an open condition to a closed condition, for example by a user who moves the panel until coupling it again to the frame, determines the movement of the control element 3 towards the second position engaging again the kinematic coupling between the coupling pin 6 and the movable element 4.

In other words, the movement of the control element 3 towards the second position returns the coupling pin 6 to the seat formed by the fork-shaped portion 5.

Moreover, the control element 3 may be disengaged from the movable element 4 by moving the coupling pin 6 from the respective fork-shaped portion 5 with axial movement along the axis "Z".

Advantageously, the lock 1 may comprise a further movable element "4*a*" designed to connect a further control handle to the control element 3. In this way, the lock 1 may have two different opening methods, for example used respectively for an opening from the inside and an opening from the outside of a caravan.

According to a possible embodiment, the control handle and the movable element 4 are operatively connected for acting on the closing panel from the outside of a room, for example the cabin of a caravan, and the further control handle and the further movable element 4*a* are operatively connected for acting on the closing panel from the inside of the room.

The control element 3 is also rotationally coupled to an operating element 7.

More specifically, the lock 1 comprises an operating element 7 mounted on the supporting base 2 in a rotatable fashion, preferably, about the axis of rotation "Z" and connected or connectable to means for releasing the above-mentioned closing panel.

The expression "connected or connectable" means that the operating element 7 is designed to be connected to means for releasing the above-mentioned closing panel.

Moreover, the operating element 7 can rotate between a first position corresponding to an open condition of the panel and a second position corresponding to a closed condition of the panel.

According to a possible embodiment and as illustrated in the accompanying drawings, the operating element 7 may comprise a first and a second counter-rotating operating body "7*a*", "7*b*" connected to respective release means, for example a Bowden cable connected to the latch of the panel.

According to further embodiments not illustrated in the accompanying drawings, the operating element 7 may comprise a different number of operating bodies and/or the release means may be of a different type to that previously indicated without altering the inventive concept which forms the basis of the invention.

The lock 1 also comprises a mechanical transmission 8 acting between the movable element 4 and the operating element 7.

In other words, the mechanical transmission 8, and in particular the control element 3, is designed to kinematically connect together the movable element 4 and the operating element 7 in such a way that a movement of the movable element 4 causes a rotation of the operating element 7 about the axis of rotation "Z".

Advantageously, the control element 3 and the operating element 7 can be coupled by means of a shape coupling contributing to limiting the number of components of the lock 1.

More specifically, the mechanical transmission 8 may comprise a pin 9 designed to define the above-mentioned shape coupling.

The pin 9 may be mounted on the supporting base 2 rotatably about the axis of rotation "Z".

Preferably, the coupling between the pin 9 and at least one between the control element 3 and the operating element 7 is made by means of a grooved connection along the axis of rotation "Z".

According to a possible embodiment and as illustrated in the accompanying drawings, the pin 9 is connected to the control element 3 by a grooved connection.

More specifically, the control element 3 may be permanently connected in a rotational fashion, in a relative axial sliding, with the pin 9 by means of the above-mentioned grooved connection.

Preferably, the pin 9 is designed to engage in a seat 10 of the control element 3 for coupling the control element 3 and the operating element 7.

Moreover, the pin 9 may be rotationally integral in a permanent fashion with the operating element 7.

More specifically, the pin 9 may be made integrally in one piece with the operating element 7.

Advantageously, the pin 9 may have a hollow shape and the supporting base 2 may comprise a tubular body 11 having a direction of extension parallel to the axis of rotation "Z".

According to this embodiment, the pin 9 is designed to be fitted on the tubular body 11 and the tubular body 11 is designed to rotatably support the pin 9 during the movement.

According to a further embodiment not illustrated in the accompanying drawings, the operating element 7 may have a coupling seat designed to receive a respective coupling portion of the pin 9 forming a shape coupling. Moreover, in accordance with this embodiment, the pin 9 may have an end portion designed to engage in a respective housing of the supporting base 2 for making a rotatable coupling without altering the inventive concept of the invention.

Moreover, the lock 1 comprises uncoupling means 12 acting on the mechanical transmission 8 for disengaging kinematically, and in a controlled way, the movable element 4 from the operating element 7 so as to disable an actuation of the operating element 7 by the movable element 4.

In other words, the uncoupling means 12 are configured to uncouple the movement of the control element 3 and/or the movable element 4 from that of the operating element 7.

More specifically, the uncoupling means 12 act in such a way as to move axially between each other the control element 3 and/or the operating element 7, preferably by moving away from each other, in such a way as to disengage the grooved connection and/or the kinematic coupling defined by the fork-shaped portion 5 and by the coupling pin 6.

Preferably, the uncoupling means 12 comprise a uncoupling element 13 interposed between the control element 3 and the operating element 7.

According to a possible embodiment and as illustrated in the accompanying drawings, the uncoupling means 12 can be connected or connectable to the further movable element "4*a*" to allow the actuation of the control element 3.

Moreover, the uncoupling means 12 may comprise an intermediate element 14 rotatable about the axis of rotation "Z", preferably fixed axially, and which can be operated in a controlled manner.

Advantageously, the uncoupling element 13 may be mounted on the intermediate element 14 by means of a grooved coupling in such a way that the uncoupling element 13 is rotationally integral with the intermediate element 14 and axially slidable relative to it.

In other words, the uncoupling element 13 is rotationally constrained to the intermediate element 14 and axially translatable relative to it.

According to a possible embodiment and as illustrated in the accompanying drawings, the uncoupling means 12 are fitted on the pin 9.

More specifically, the pin 9 has a first portion "9*a*" having a cylindrical shape configured for supporting the above-mentioned uncoupling means 12 and a second portion "9*b*" having a quadrangular shape designed to define the grooved connection with the control element 3.

As described above, the uncoupling element 13 can be rotated about the axis of rotation "Z" in a controlled manner for uncoupling rotationally with each other the control element 3 and the operating element 7.

Preferably, the uncoupling element 13 can be axially translated, under the action of cam means 15, to receive a movement along the axis "Z" following a rotation of the uncoupling means 12 about the axis of rotation "Z" and perform the axial movement of the control element 3.

More specifically, the cam means 15 may comprise a fixed ramp 16 which can be engaged by a portion of the uncoupling element 13 during the rotation about the axis of rotation "Z" to receive, following the above-mentioned rotation, an axial translation movement along the axis of rotation "Z".

More specifically, the uncoupling element 13 may have at least one radial protrusion "13*a*" which, intercepting the plane defined by the fixed ramp 16, causes a movement of the uncoupling element 13 along the axis of rotation "Z".

The uncoupling element 13 also has axial protrusions engaged in sliding against a thrust surface of the control element 3 in such a way as to allow a reciprocal rotation between the uncoupling element 13 and the control element 3 in a mutual axial contact configuration, in particular during the axial movement of the control element 3 actuated by the uncoupling element 13.

Figure 5:
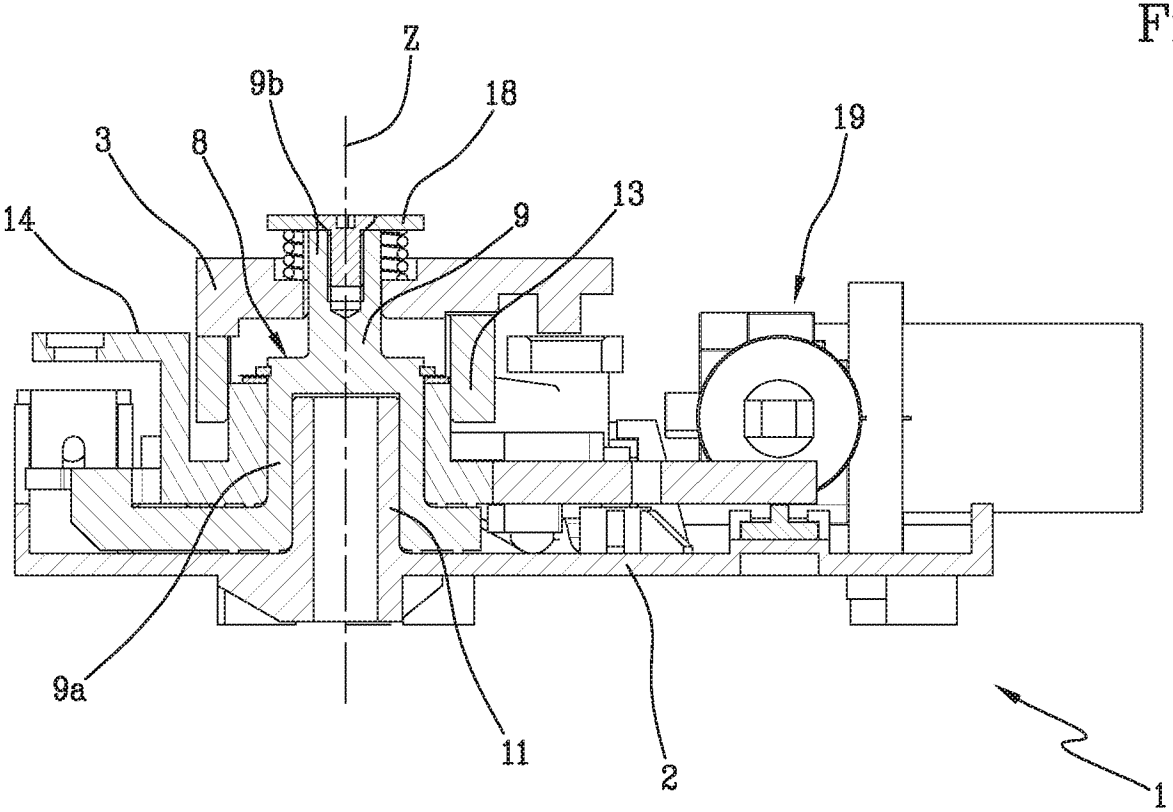
FIG. 5 is a cross section view of the lock according to the invention according to a further possible operating condition.
Figure 6:
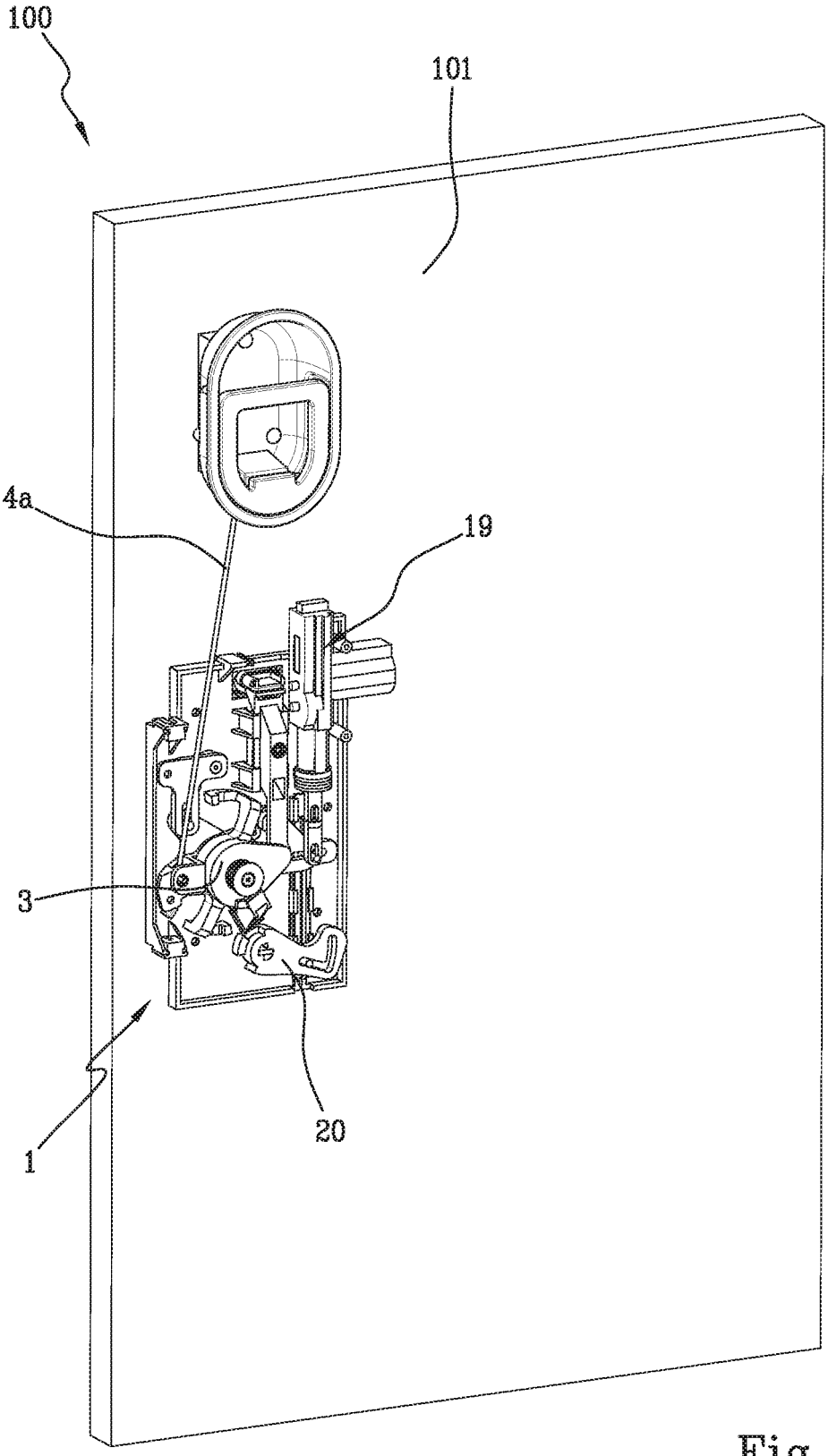
FIG. 6 is a perspective view of a closing device according to a further aspect of the invention.
Figure 7:
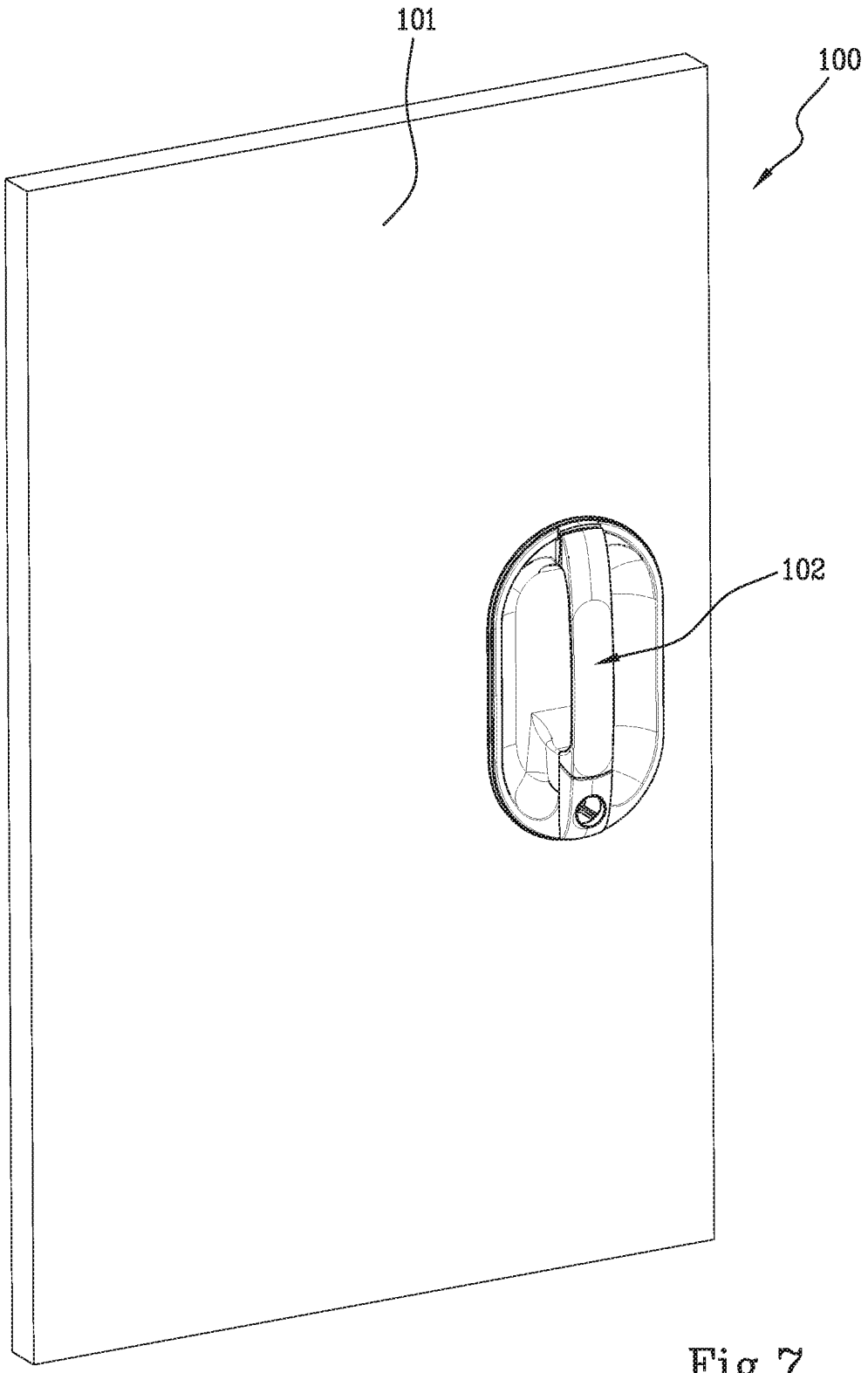
FIG. 7 is a further perspective view of the closing device of FIG. 6.

In this way, the control element 3 can translate, for example until disengaging the coupling pin 6 from the fork-shaped portion 5 of the movable element 4, performing a kinematic uncoupling between the control element 3 and the operating element 7 (as illustrated in FIG. 5).

According to a possible embodiment and as illustrated in the accompanying drawings, the control element 3 has at least one contact element "3*a*" configured for making contact with a respective element 17 of the supporting base 2 in such a way as to prevent a translation of the control element 3 along the axis of rotation "Z" during an open condition of the panel.

More specifically, the uncoupling element 13 may comprise at least one tooth "13*b*" designed to slide in rotation in a suitable rotation seat "3*b*" of the control element 3 in such a way as to uncouple the rotation of the uncoupling element 13 from the movement of the control element 3.

Moreover, the lock 1 may comprise a fixed contact element 18 axially spaced from the control element 3 designed to define an axial limit stop for the control element 3.

More specifically, the lock 1 may comprise opposing elastic means, preferably a spring, designed to oppose an axial movement of the uncoupling means 12, preferably of the uncoupling element 13.

Preferably, the uncoupling element 13 can be rotated about the axis of rotation "Z" by means of a mechanical actuator and/or a pneumatic actuator and/or by means of a manual action, for example by moving a lever or a key.

According to a possible embodiment and as illustrated in the accompanying drawings, the lock 1 comprises a mechanical actuator 19 and a movement lever 20 which can be operated by a key.

The mechanical actuator 19 and the movement lever 20 are configured for actuating the uncoupling element 13 in such a way as to rotationally uncouple the control element 3 from the operating element 7.

Preferably, the above-mentioned actuators are configured for actuating the uncoupling element 13 in a closed condition of the panel.

Advantageously, the operating element 7 and/or the mechanical transmission 8 and/or the control element 3 are made at least partly, preferably entirely, of plastic material.

According to a possible embodiment, the operating element 7, the mechanical transmission 8 and the control element 3 are made of plastic material in such a way as to limit the occurrence of relative forces between the components due to any thermal expansions and/or contractions.

In use and in accordance with the specific configuration illustrated in FIG. 1, during an operation for opening from the outside the user acts on the control handle causing the movement of the movable element 4 and therefore a clockwise rotation of the control element 3.

The control element 3 rotates the first operating body "7*a*" which, in turn, moves the second operating body "7*b*". The movement of the first operating body "7*a*" and of the second operating body "7*b*" actuates the release means causing the release of the closing panel.

During an opening operation from the inside the user acts on the further control handle, for example pulling it, causing the movement of the further movable element "4*a*" and of the control element 3 in a clockwise direction. The control element 3 rotates the first operating body "7*a*" which, in turn, moves the second operating body "7*b*". The movement of the first operating body "7*a*" and of the second operating body "7*b*" actuates the release means causing the release of the closing panel.

Moreover, with regard to the activation of the uncoupling means 12, the user can actuate the mechanical actuator 19, for example by means of a remote control, or act on the movement lever 20, for example which can be activated by means of a key, determining, respectively, an anticlockwise rotation of the uncoupling means which, thanks to the presence of the fixed ramps 16, determine a translation of the control element 3 along the axis of rotation "Z" uncoupling it from the movable element 3 or, in an embodiment not illustrated, from the operating element 7. In this situation, each opening attempt by means of the movable element 4 (through the control handle) is ineffective because the control element 3 is disengaged from the movable element 4 (coupling pin 6 disengaged from the respective fork-shaped portion 5).

The user can also actuate the uncoupling means 12 acting on the further control handle, for example by pressing it, in such a way as to determine an anticlockwise movement of the uncoupling means 12.

In accordance with a further inventive aspect, this invention relates to a closing device 100 comprising a movable panel 101, in particular a closing sash, door or window.

The closing device 100 comprises at least one lock 1, mounted on the movable panel 101, and one or more locking rods connected or connectable to the operating element and able to be moved axially between a closed condition in which they define a locking of the panel and an open condition in which they allow movement of the panel.

Moreover, the device comprises a control handle 102 mounted on the panel and connected to the movable element 4 for promoting an opening and/or a closing of the movable panel 101.

Advantageously, the closing device 100 may also comprise a further control handle connected to the further movable element "4*a*" to allow a different type of locking and/or releasing of the panel.

It should be noted, therefore, that the invention achieves the preset aims by providing a particularly efficient lock and having an increased duration of the operating life relative to the prior art devices thanks to the presence of uncoupling means acting on the mechanical transmission for uncoupling rotationally, and in a controlled manner, the control element and/or the movable element from the operating element.

Advantageously, this kinematic uncoupling makes it possible to limit the mechanical wear due to the relative movement of the components, for example induced by vibration loads to which the lock may be subjected during the movement of the caravan.

Moreover, the use of plastic material for the components allows the occurrence of forces due to the thermal variations to be limited determining an increase in the operating life of the lock.

The invention claimed is:

1. A lock comprising:

a supporting base;

a movable element connected or connectable to a control handle to be operated by a user; wherein said movable element is movable between a first control handle position corresponding to an open condition of said control handle and a second control handle position corresponding to a closed condition of said control handle;

an operating element rotatably mounted on the supporting base about an axis of rotation to cause release of a closing panel, said operating element being rotatable between a first panel position corresponding to an open condition of the panel and a second panel position corresponding to a closed condition of the panel;

a mechanical transmission acting between said movable element and said operating element and configured to connect kinematically said movable element and operating element such that a movement of said movable element causes a rotation of said operating element about said axis of rotation;

an uncoupling mechanism acting on the mechanical transmission for disengaging kinematically said movable element from said operating element to disable an actuation of said operating element by the movable element;

wherein said mechanical transmission comprises a pin rotatably mounted on said supporting base coaxially with said axis of rotation and a control element rotatably mounted on the pin also coaxially with said axis of rotation and connectable to said movable element, such that a movement of the movable element causes a rotation of the control element about said axis of rotation, said pin being rotatably coupled with said control element and operating element for transmitting a mechanical torque about said axis of rotation;

wherein the coupling between said pin and at least one chosen from said control element and operating element is formed by a splined connection surrounding and extending along said axis of rotation; and wherein said uncoupling mechanism is configured to axially move the control element along the axis of rotation to disengage the control element from the splined connection and/or from the movable element.

2. The lock according to claim 1, wherein said pin is connected to said control element by said splined connection; and wherein said pin is rotationally integral in a permanent fashion with said operating element, said control element being rotationally connected, and with a relative axial sliding movement, with the pin by said splined connection.

3. The lock according to claim 1, wherein said uncoupling mechanism comprises an uncoupling element interposed between the control element and said operating element, said uncoupling element being rotatable about said axis of rotation; wherein the uncoupling element is axially translatable, under action of a cam, for receiving a movement along said axis of rotation following a rotation of the uncoupling means about said axis of rotation and forming said axial movement of the control element; and wherein the uncoupling element is rotatable about said axis of rotation for uncoupling from each other said movable element and said operating element.

4. The lock according to claim 3, wherein the uncoupling element is rotatable about said axis of rotation by a mechanical actuator and/or a pneumatic actuator and/or by a manual action.

5. The lock according to claim 3, wherein said cam comprises a fixed ramp engageable by a portion of said uncoupling mechanism during the rotation about said axis of rotation such that the uncoupling mechanism receives, following the rotation about said axis of rotation, an axial translation movement along said axis of rotation.

6. The lock according to claim 3, wherein said uncoupling element has axial protrusions engaged in a sliding manner against a pushing surface of the control element to allow a reciprocal rotation between the uncoupling element and the control element in a configuration of mutual axial contact, during the axial movement of the control element actuated by the uncoupling element; and wherein said control element has at least one contact element configured to make contact with a respective locking element of said supporting base, said contact element being configured to prevent a translation of said control element along said axis of rotation during an open condition of the panel.

7. The lock according to claim 3, wherein said uncoupling mechanism comprises an intermediate element rotatable about said axis of rotation, said uncoupling element being mounted on said intermediate element by a splined coupling along the axis of rotation such that said uncoupling element is rotationally integral with the intermediate element and axially slidable relative to the intermediate element.

8. The lock according to claim 1, wherein the movable element is defined by a rod or slider provided with translational movement and coupled to the control element in an eccentric portion with respect to said axis of rotation by coupling pin movable by a fork-shaped portion of the movable element.

9. The lock according to claim 1, and further comprising a spring, configured to oppose an axial movement of said uncoupling mechanism.

10. The lock according to claim 1, and further comprising a fixed contact element which is axially spaced from said control element, said fixed contact element defining an axial end of stroke position for said control element.

11. The lock according to claim 1, wherein said supporting base and/or said operating element and/or said transmission and/or said control element are made at least partly of plastic material.

12. The lock according to claim 1, wherein said supporting base has a main plane on which it lies and wherein said axis of rotation is perpendicular to said main plane.

13. A closing device comprising:

a movable panel;

at least one lock according to claim 1 and mounted on said movable panel;

one or more locking rods connected or connectable to said operating element and movable axially between a closed condition in which the one or more rods define a locking of the movable panel and an open condition in which the one or more rods allow movement of the movable panel;

a control handle mounted on the movable panel and connected to said movable element to promote an opening and/or closing of said movable panel.

* * * * *